United States Patent [19]

Critchley et al.

[11] Patent Number: 4,980,094

[45] Date of Patent: Dec. 25, 1990

[54] METHODS AND APPARATUS FOR CLOSING AND CHARGING RADIOACTIVE WASTE CONTAINERS

[75] Inventors: Richard J. Critchley, Chorley; Samuel R. Oldham, Hyde, both of United Kingdom

[73] Assignee: British Nuclear Fuel plc, Warrington, England

[21] Appl. No.: 307,097

[22] Filed: Feb. 7, 1989

[30] Foreign Application Priority Data

Feb. 26, 1988 [GB] United Kingdom ..... 8804496

[51] Int. Cl.[5] ..... G21F 9/12; G21F 9/24; B65D 41/10; B65D 41/12

[52] U.S. Cl. ..... 252/633; 220/309; 220/310; 220/356; 220/357; 250/506.1; 250/507.1; 376/264; 376/272; 422/903

[58] Field of Search ..... 252/633, 628; 250/506.1, 507.1; 100/56, 59, 61; 422/903; 376/261, 263, 264, 272; 220/233, 240, 287, 306–307, 309–310, 356–357

[56] References Cited

U.S. PATENT DOCUMENTS

| | | | |
|---|---|---|---|
| 1,263,786 | 4/1918 | Mehring | 100/59 |
| 1,589,686 | 6/1926 | Grabs | 100/59 |
| 2,214,732 | 9/1940 | Kraft | 206/2 |
| 2,684,778 | 7/1954 | Staller | 220/24 |
| 3,640,422 | 2/1972 | Harschel | 220/24.5 |
| 4,297,161 | 10/1981 | Graffin | 100/61 |
| 4,446,063 | 5/1984 | Critchley et al. | 252/633 |
| 4,590,000 | 5/1986 | Baatz et al. | 252/633 |
| 4,760,268 | 7/1988 | Noe | 252/633 |
| 4,760,783 | 8/1988 | Torita et al. | 252/633 |

FOREIGN PATENT DOCUMENTS

| | | | |
|---|---|---|---|
| 0105002 | 4/1984 | European Pat. Off. | 252/633 |
| 0217999 | 4/1987 | European Pat. Off. . | |
| 552519 | 8/1974 | Switzerland . | |
| 1080005 | 8/1967 | United Kingdom . | |
| 1358946 | 7/1974 | United Kingdom . | |
| 1393481 | 5/1975 | United Kingdom . | |
| 1519440 | 7/1978 | United Kingdom . | |
| 2044718 | 10/1980 | United Kingdom | 100/56 |
| 2058026 | 4/1981 | United Kingdom . | |
| 2199092 | 6/1988 | United Kingdom . | |
| 81/01695 | 6/1981 | World Int. Prop. O. . | |

*Primary Examiner*—Howard J. Locker
*Attorney, Agent, or Firm*—William R. Hinds

[57] ABSTRACT

Waste material is passed from a cell 10 through a port 12 into drum 48 which has a mouth 49 with a removable lid 54. A port door 28 includes an electromagnet 54*a* to hold the lid to the door 28 and both are moved into the cell to allow loading of the drum and after re-closure of door and lid swaging tools 34 operate to deform the lid to form one or more lips which engage under the margin around mouth 49 to resist separation of the lid from the drum.

Seals 30, 32, 52 are provided.

12 Claims, 4 Drawing Sheets

METHODS AND APPARATUS FOR CLOSING AND CHARGING RADIOACTIVE WASTE CONTAINERS

Figure 1:
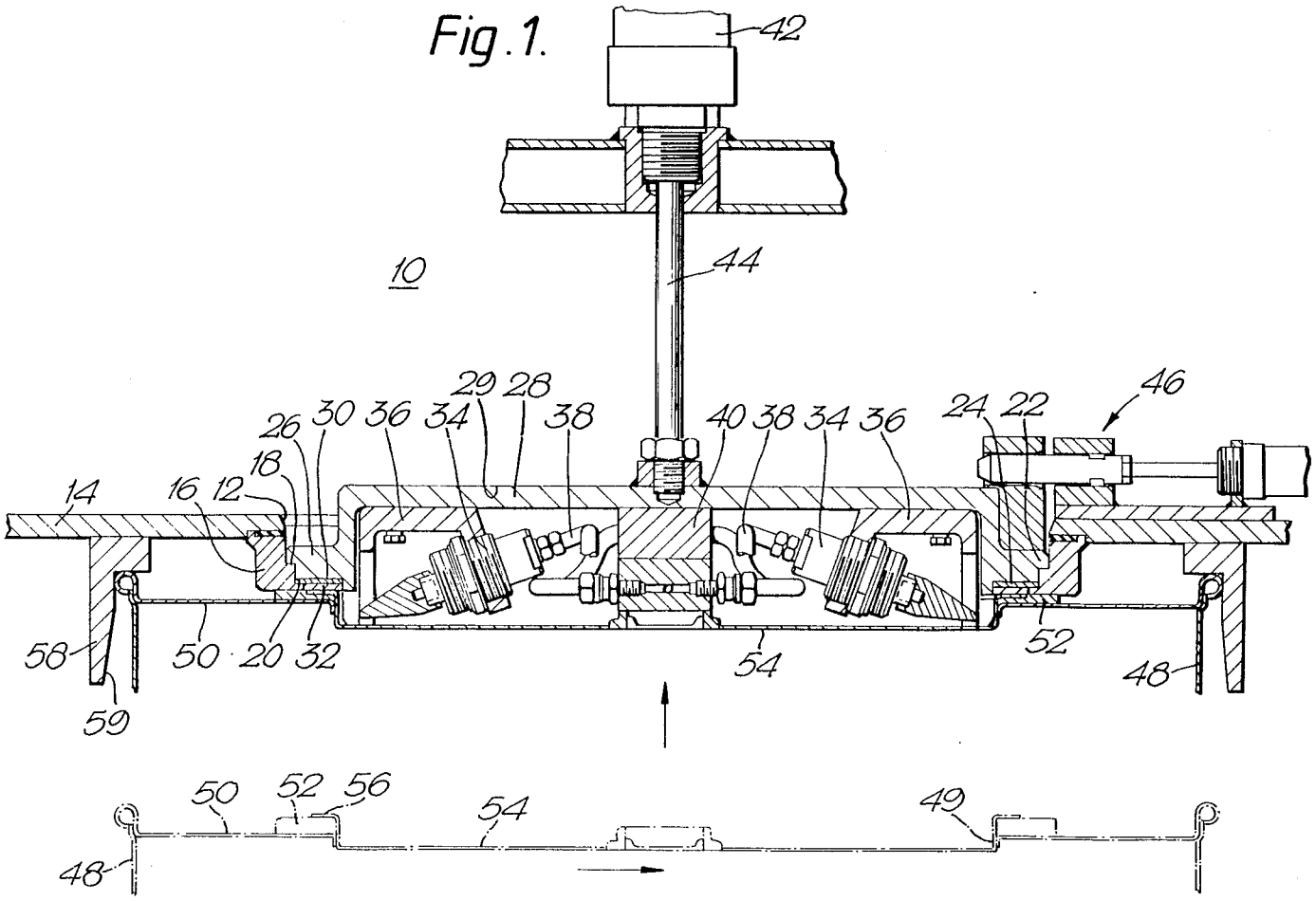

This invention relates to methods and apparatus for charging or transferring radioactive waste material into storage containers.

British Specification No. 2088836 and U.S. Pat. No. 4,446,063 describe the charging of radioactive waste into a steel drum having a lid in which a dispenser closure and the lid are withdrawn into the dispenser in back-to-back fashion. In the closed position the lid is an interference fit in an opening in a wall of the drum.

According to the present invention, there is provided a method of charging radioactive waste material into a storage container provided with a mouth having a lid, the method comprising offering the container up to a radioactive waste dispenser having a port provided with a closure so that the container is sealed to the dispenser, withdrawing the dispenser closure and the lid in a back-to-back fashion into the dispenser, transferring radioactive waste material from the dispenser to the container through the port and the container mouth, replacing the dispenser closure in the port and the lid on the container, and mechanically deforming the lid laterally outwardly to form at least one laterally enlarged lip which engages behind the wall of the container containing the mouth to resist removal of the lid from the container.

A continuous lip may be formed around the entire lid, or a plurality of angularly spaced lips may be formed.

The lid may be an interference fit in the mouth of the container.

The lid may be provided with a peripheral flange which rests against an outer surface of the wall of the container so that the flange resists the lid moving into the container and the lip or lips resist the lid being removed from the container.

When the lid is provided with a flange, an annular seal may be provided in the wall around the mouth of the container or on the flange so that when the lid is fitted in the mouth of the container the seal is trapped between the flange and the wall.

According to the present invention there is also provided a radioactive waste transfer apparatus for use in transferring radioactive waste material from a radioactive waste dispenser having a port to a storage container having a mouth provided with a lid, said apparatus comprising a port door locatable in the port, means for selectively sealing the container to the dispenser about the port door, means for selectively releasably holding the lid to the port door, means for withdrawing the port door with the lid from the port into the dispenser and for replacing the port door in the port and the lid in the mouth, and means on the port door for applying a force to the lid to mechanically deform the lid laterally outwardly and form at least one laterally enlarged lip thereon to engage behind the wall of the container containing the mouth to resist removal of the lid from the container.

Preferably, the port door is provided with means for sealing the lid with respect to the port door. The sealing means may for example be a rubber seal.

The force applying means is preferably arranged to deform the lid near the lid periphery so as to form a lip container provided with the mouth to resist removal of the lid from the container. The force applying means may be mounted for rotation and may comprise one or more swaging tools.

Also according to the present invention there is provided a radioactive waste charging apparatus for use in charging radioactive waste material into a storage container provided with a mouth having a lid, comprising radioactive waste dispenser means having a port provided with a closure, means for selectively sealing the container to the dispenser about the closure, means for withdrawing the dispenser closure and the lid in a back-to-back fashion into the dispenser for transfer of radioactive waste material from the dispenser to the container through the port and the container mouth and for replacing the dispenser closure in the port and the lid on the container, and means for mechanically deforming the lid laterally outwardly to form at least one laterally enlarged lip which engages behind the wall of the container containing the mouth of resist removal of the lid from the container.

The invention will now be further described by way of example only, with reference to the accompanying drawings, in which FIGS. 1 to 4 are fragmentary side views part in vertical section of a cell for handling radioactive materials and a disposal drum and illustrate the stages involved in charging the drum.

The drawings show a cell 10 used for handling radioactive material which is provided with a circular port 12 in one of its walls 14 to enable waste to be removed from the cell 10. A circular seal ring 16 extends around the periphery of the port 12 and downwards from the cell wall 14. The seal ring 16 on its radially inner side has two annular steps 18 and 20 which face towards the interior of the cell 10. A port door 28 has an outwardly extending peripheral flange 26 having downwardly facing annular shoulders 22 and 24 which respectively seat on steps 18, 20 when the door 28 is closed. A first port seal 30 is provided on the radially outer shoulder 24 such that when the port door 28 closes the port 12 a radially outer part of the first port seal 30 is compressed between the shoulder 24 and the step 20 to seal the port 12. A second port seal 32 is located on the radially inner part of the first port seal 4.

The port door 28 is of hollow cylindrical form closed at its upper end 29 and its interior is provided with two orthogonal pairs of swaging tools 34 which are respectively mounted on supports 36 secured to top wall 29 so that the tools 34 extend at an angle outwardly and downwardly with respect to the port door 28. The tools 34 are connected to a hydraulic power system (not shown) via pipes 38 and a manifold 40. The port 12 is opened and closed by movement of the port door 28 using a pneumatic cylinder 42 connected to the port door 28 via a piston rod 44. When closed, the port door 28 can be locked in position using a locking arrangement 46.

The drawings also show a disposal drum 48 having an opening or mouth 49 in its top wall 50 and a drum seal 52 located on the radially inner end of the top wall 50 around the opening 49. The drum 48 is closed by means of a shallow cylindrical lid 54 having a peripheral flange 56 such that when the lid 54 is placed in the opening 49 the lid 54 is a loose fit in the opening 49 and the flange 56 overlies and engages a radially inner portion of the drum seal 52. The lid could be an interference fit in the opening 49.

In use, the drum 48 is presented to the port 12 and positioned with the aid of a surrounding annular guide 58 having an upwardly and inwardly inclined inner surface 59 so that the lid 54 is disposed beneath the port door 28 and the radially outer portion of the drum seal 52 is compressed (by about 50%) between the seal ring 16 and the top 50 of the drum 48. The lid 54, which is typically formed from steel, is attached to the port door 28 by magnetism using an electromagnet indicated schematically at 54*a* in FIG. 4 with the flange 56 of the lid 54 in contact with the second port seal 32 so that the lid 54 is sealingly secured to the port door 28.

Figure 2:
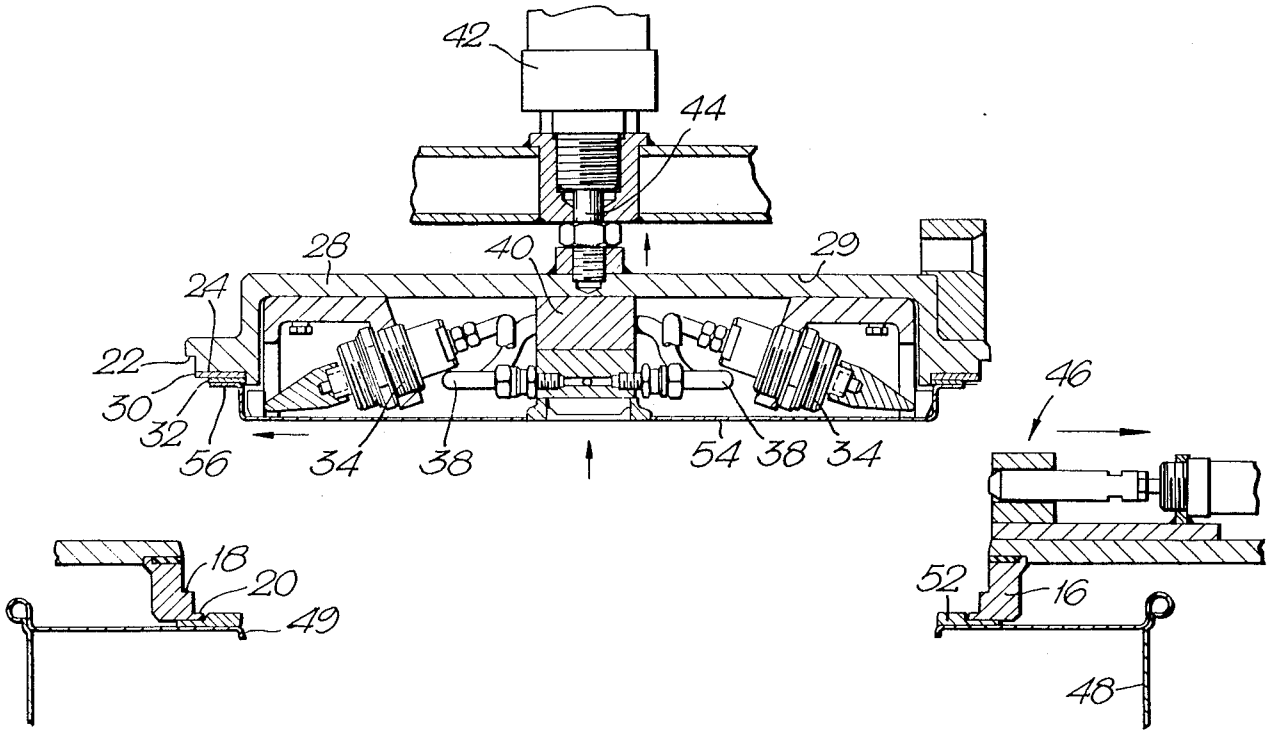
Figure 3:
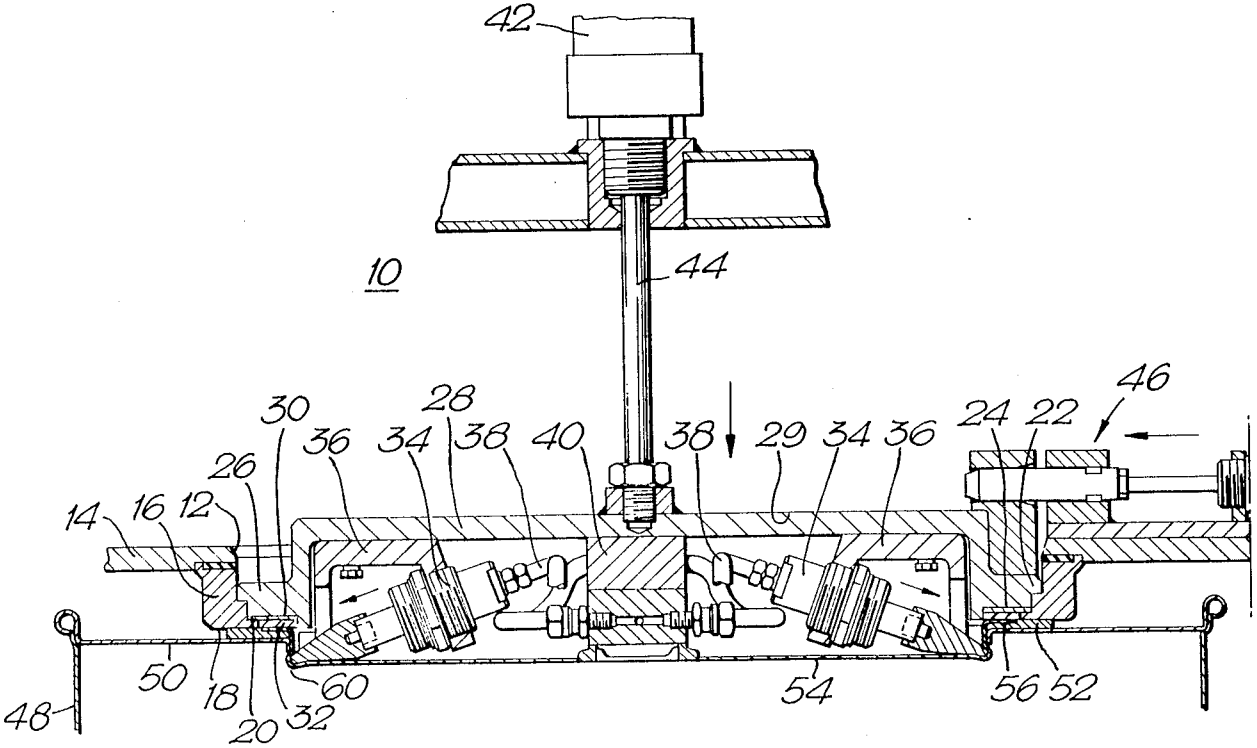
Figure 4:
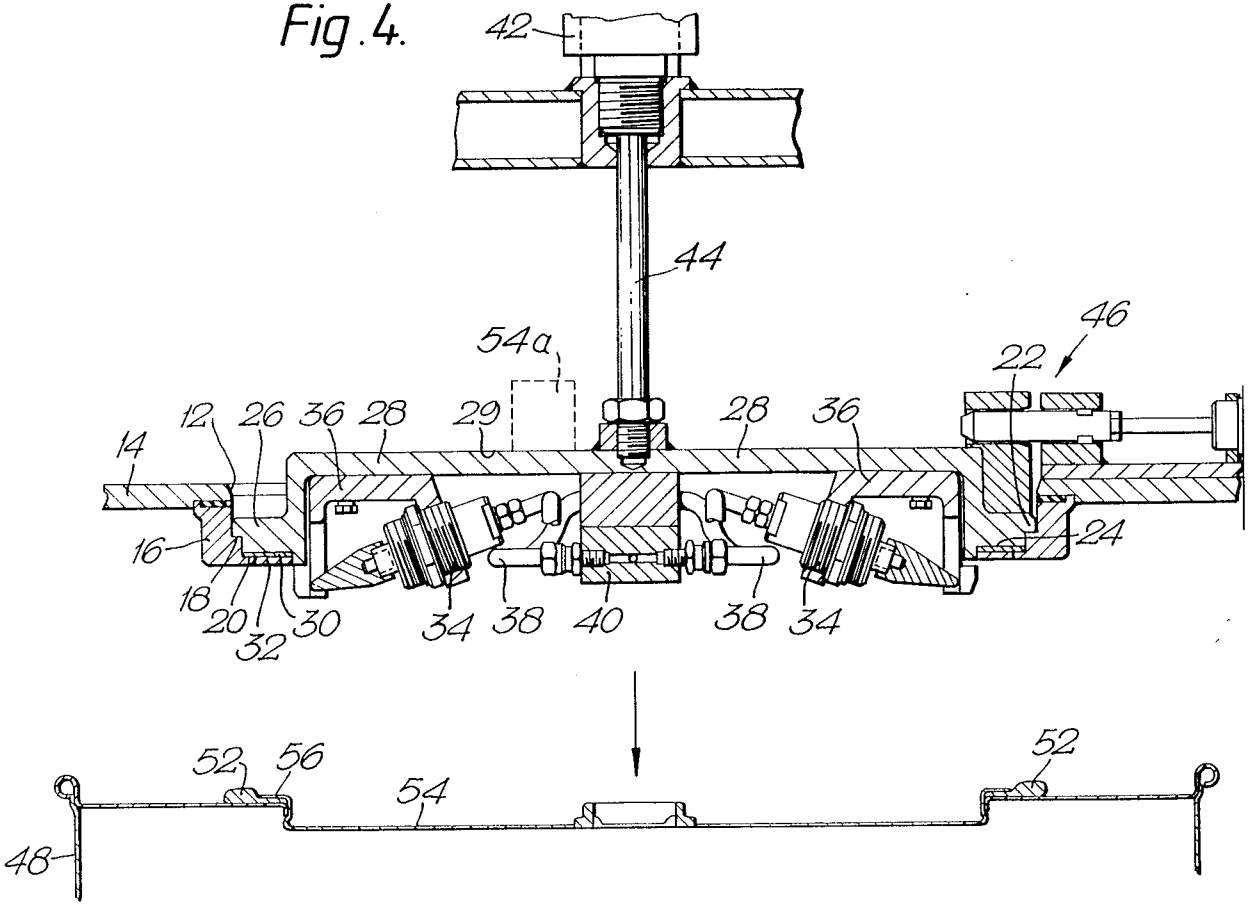

As shown in FIG. 2, the pneumatic cylinder 42 is actuated to draw the port door 28 and lid 54 into the cell 10 in a back-to-back fashion. The inner portion of the drum seal 52 then expands into the port 12. Waste material is then loaded into the drum 48 through the port 12 and the port door 28 then lowered to re-close the port 12 and at the same time replace the lid 54 in the opening 49 of the drum 48, thus again compressing the radially inner portion of the drum seal 52 (see FIG. 3). The swaging tools 34 are then operated as indicated by the arrows to push the lid 54 out near the lid periphery to form two opposed lips 60 under a marginal portion of the top 50 of the drum 48 around the mouth 49. After formation of the lips, the tools 34 are retracted. Thus the drum seal 52 seals the lid 54 to the drum 48, whilst the lips 60 resist or effectively prevent removal of the lid 54. The drum can then be moved away.

The swaging can be carried out at angular intervals around the whole circumference to deform the lid to produce one continuous lip 60 extending around the entire lid in which case the lip 60 may act as a secondary seal. Alternatively, the swaging tools, or a single swaging tool, can be rotatably mounted on the port door. Preferably there are at least three equally spaced tools.

We claim:

1. A method of charging radioactive waste material into a storage container provided with a mouth having a lid, the method comprising offering the container up to a radioactive waste dispenser having a port provided with a closure so that the container is sealed to the dispenser, withdrawing the dispenser closure and the lid in a back-to-back fashion into the dispenser, transferring radioactive waste material from the dispenser to the container through the port and the container mouth, replacing the dispenser closure in the port and the lid on the container, and mechanically deforming the lid laterally outwardly to form at least one laterally enlarged lip which engages behind the wall of the container containing the mouth to resist removal of the lid from the container.

2. A method as claimed in claim 1, in which the lid has a peripheral flange which rests against an outer surface of the wall of the container so that the flange resists the lid moving into the container and the lip or lips resist the lid being removed from the container.

3. A method as claimed in claim 2, in which a seal is provided in the wall around the mouth of the container or on the flange so that when the lid is fitted in the mouth of the container the seal is trapped between the flange and the wall.

4. A method as claimed in claim 1, in which the lip is continuous around the lid.

5. A method as claimed in claim 1, in which a plurality of angularly spaced lips are formed.

6. A radioactive waste transfer apparatus for use in transferring radioactive waste material from a radioactive waste dispenser having a port to a storage container having a mouth provided with a lid, said apparatus comprising a port door locatable in the port, means for selectively sealing the container to the dispenser about the port door, means for selectively releasably holding the lid to the port door, means for withdrawing the port door with the lid from the port into the dispenser and for replacing the port door in the port and the lid in the mouth, and means on the port door for applying a force to the lid to mechanically deform the lid laterally outwardly and form at least one laterally enlarged lip thereon to engage behind the wall of the container containing the mouth to resist removal of the lid from the container.

7. Apparatus as claimed in claim 6, in which the port door is provided with means for sealing the lid with respect to the port door.

8. Apparatus as claimed in claim 6, in which the force applying means is arranged to form a plurality of spaced lips.

9. Apparatus as claimed in claim 6, in which the force applying means is arranged to form a continuous lip around the lid.

10. Apparatus as claimed in claim 6, in which the force applying means is mounted for rotation.

11. Apparatus as claimed in claim 6, in which the force applying means comprises at least one swaging tool.

12. A radioactive waste charging apparatus for use in charging radioactive waste material into a storage container provided with a mouth having a lid, comprising radioactive waste dispenser means having a port provided with a closure, means for selectively sealing the container to the dispenser about the closure, means for withdrawing the dispenser closure and the lid in a back-to-back fashion into the dispenser for transfer of radioactive waste material from the dispenser to the container throught the port and the container mouth and for replacing the dispenser closure in the port and the lid on the container, and means for mechanically deforming the lid laterally outwardly to form at least one laterally enlarged lip which engages behind the wall of the container containing the mouth to resist removal of the lid from the container.

* * * * *